US007567775B2

(12) United States Patent
Fukuhara

(10) Patent No.: US 7,567,775 B2
(45) Date of Patent: Jul. 28, 2009

(54) IMAGE FORMING APPARATUS HAVING A RETRACTING AND A MOVING MECHANISMS AND IMAGE FORMING METHOD THEREOF

(75) Inventor: Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/956,987

(22) Filed: Dec. 14, 2007

(65) Prior Publication Data

US 2008/0317518 A1 Dec. 25, 2008

(30) Foreign Application Priority Data

Jun. 25, 2007 (JP) ..... 2007-166492

(51) Int. Cl.
*G03G 15/16* (2006.01)

(52) U.S. Cl. ..... 399/302

(58) Field of Classification Search ..... 399/302, 399/223, 313, 303, 306, 308
See application file for complete search history.

(56) References Cited

U.S. PATENT DOCUMENTS

2003/0091368 A1* 5/2003 Yamamoto et al. ..... 399/116
2004/0105693 A1* 6/2004 Akizuki et al. ..... 399/69
2004/0174426 A1* 9/2004 Nomura et al. ..... 347/238
2006/0127134 A1* 6/2006 Sakamaki et al. ..... 399/223
2007/0059041 A1* 3/2007 Iwasaki ..... 399/167
2007/0077095 A1* 4/2007 Ueda et al. ..... 399/249
2007/0196141 A1* 8/2007 Kitagawa et al. ..... 399/302

FOREIGN PATENT DOCUMENTS

JP 2006-139063 6/2006

* cited by examiner

*Primary Examiner*—Quana M Grainger
(74) *Attorney, Agent, or Firm*—Morgan, Lewis & Bockius LLP

(57) ABSTRACT

An image forming apparatus includes a transparent image forming unit having a transparent image carrier; plural color image forming units arranged on a downstream side in a process direction of the transparent image forming unit, the color image forming units having color image carriers; a black image forming unit arranged between the transparent image forming unit and the color image forming unit or on the downstream side of the color image forming units, the black image forming unit having a black image carrier; an intermediate transfer member to which the toner images formed in the respective image carriers are transferred; a retracting mechanism that brings the transparent image carrier into contact with or separates it from the intermediate transfer member; and a moving unit that brings the intermediate transfer member into contact with or separates it from the color image carrier.

14 Claims, 14 Drawing Sheets

IMAGE FORMING APPARATUS HAVING A RETRACTING AND A MOVING MECHANISMS AND IMAGE FORMING METHOD THEREOF

CROSS-REFERENCE TO RELATED APPLICATIONS

This application is based on and claims priority under 35 USC 119 from Japanese Patent Application No. 2007-166492 filed Jun. 25, 2007.

BACKGROUND OF THE INVENTION

1. Field of the Invention

The present invention relates to an image forming apparatus and an image forming method.

2. Description of the Related Art

Generally, a so-called tandem type color image forming apparatus is known as an electrophotographic color image forming apparatus such as a color copying machine, a color printer, and a color facsimile. In the tandem type color image forming apparatus having black (K), yellow (Y), magenta (M), and cyan (C) image forming units, toner images formed by the image forming units are sequentially transferred onto an intermediate transfer member, and the toner images on the intermediate transfer member are transferred onto a recording medium, thereby forming the color image on the recording medium.

In the tandem type color image forming apparatus, when rough paper such as embossed paper having low surface smoothness is used as the recording medium, a transfer potential at a recessed portion in a surface of the recording medium is lower than that of a projected portion. Therefore, the image forming unit for forming a transparent toner image is disposed on the upper-most stream side in a process direction, the toner image formed by the transparent toner is transferred onto the intermediate transfer member, and the black (K), yellow (Y), magenta (M), and cyan (C) toner images are transferred onto the transparent toner image while superposed on one another. This enables a transfer property to be improved when the toner images on the intermediate transfer member are transferred onto the recording medium.

In the case where plain paper having the high surface smoothness is used as the recording medium in the image forming apparatus having the above configuration, namely, even in the case where the transfer of the transparent toner image onto the intermediate transfer member is not required, when a transparent-toner image forming unit (photosensitive drum) is not retracted from the intermediate transfer member but is always brought into contact with the intermediate transfer member, the transparent-toner photosensitive drum is abraded to shorten a lifetime of the image forming unit.

However, in the configuration in which the image forming unit is retracted, a gear mechanism for moving the image forming unit is easily damaged.

Additionally, the color shift is increased among each of the color toner image transferred onto the intermediate transfer member due to eccentricity of the image carrier or gear.

SUMMARY OF THE INVENTION

In accordance with an aspect of the present invention, an image forming apparatus includes a transparent image forming unit having a transparent image carrier in which a transparent toner image is formed; plural color image forming units arranged at a downstream side in a process direction of the transparent image forming unit, the color image forming units having color image carriers at which yellow, magenta, and cyan color toner images are formed respectively; a black image forming unit arranged between the transparent image forming unit and the color image forming unit or at the downstream side in the process direction of the color image forming units, the black image forming unit having a black image carrier in which a black toner image is formed; an intermediate transfer member to which the toner images formed in the transparent image carrier, the color image carriers, and the black image carrier, are transferred; a retracting mechanism that brings the transparent image carrier into contact with the intermediate transfer member and separates the transparent image carrier from the intermediate transfer member; and a moving unit that brings the intermediate transfer member into contact with the color image carrier and separates the intermediate transfer member from the color image carrier.

BRIEF DESCRIPTION OF THE DRAWINGS

FIG. 3A shows a state in which a roller member is raised, and FIG. 3B shows a state in which the roller member is lowered.

FIG. 4A shows a state in which the roller member is raised, FIG. 4B shows a state in which the roller member is lowered.

DESCRIPTION OF THE PREFERRED EMBODIMENT

An image forming apparatus 10 according to an exemplary embodiment of the present invention will be described below with reference to the drawings.

Figure 1:
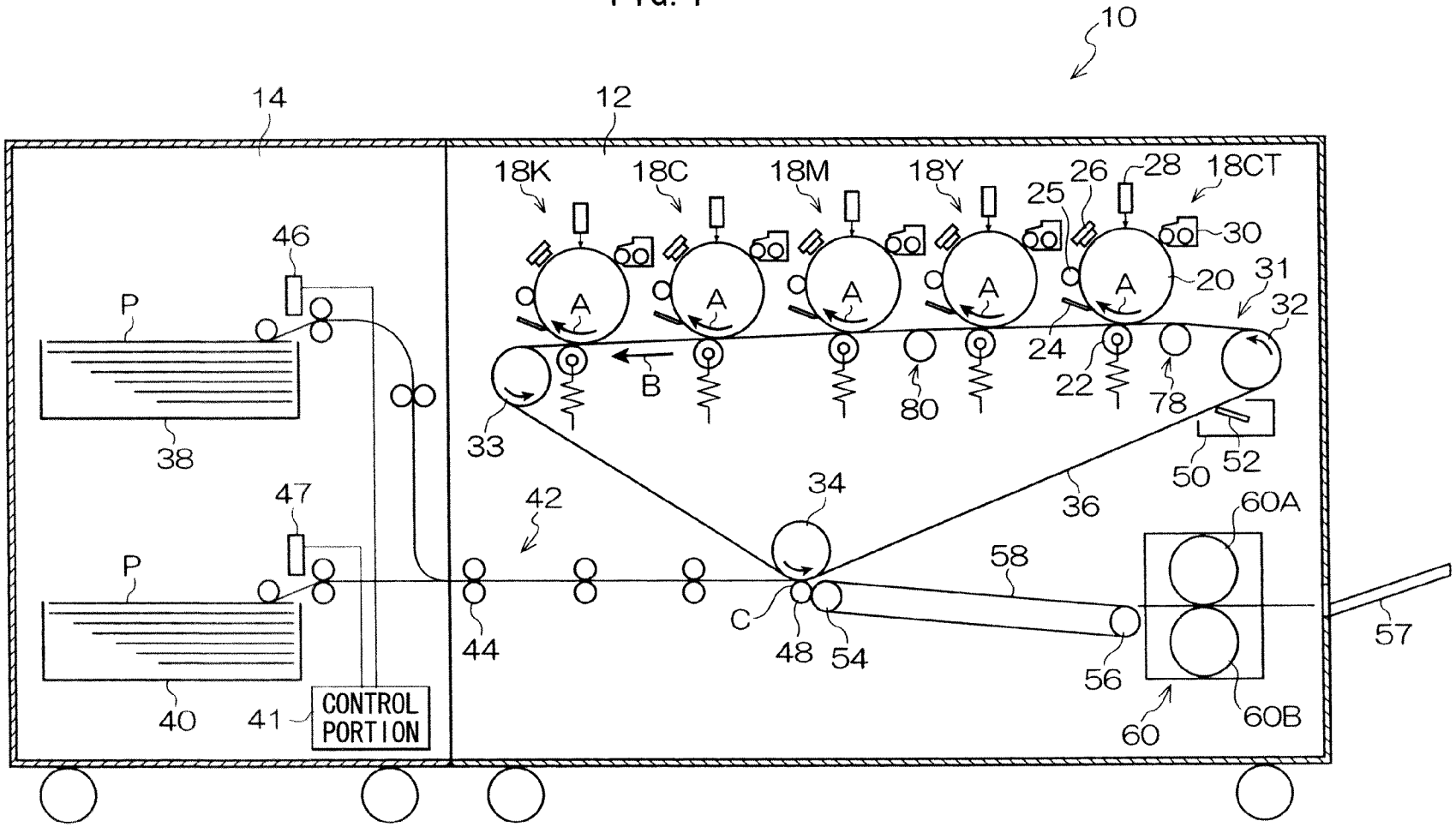
FIG. 1 is a schematic view showing an image recording apparatus according to an exemplary embodiment of the present invention.

The image forming apparatus 10 performs image processing based on image information transmitted from an image data input apparatus such as a personal computer (not shown), and the image forming apparatus 10 forms an image on recording paper P which is of the recording medium through an electrophotographic process. As shown in FIG. 1, the image forming apparatus 10 includes an image forming portion 12 which forms the image on the recording paper P and a paper feed portion 14 which feeds the recording paper P to the image forming portion 12.

The image forming portion 12 includes image forming units 18Y, 18M, 18C, and 18K which form the yellow (Y), magenta (M), cyan (C), and black (K) toner images in the order from the upstream side in a rotating direction of a photosensitive drum 20 (arrow A direction, hereinafter referred to as "process direction").

An image forming unit 18CT which forms the transparent toner (clear toner, CT) image is provided on the upstream side in the process direction of the image forming unit 18Y. In the following description, one of the letters Y, M, C, K, and CT is added to the numeral when the yellow (Y), magenta (M), cyan (C), black (K), and transparent (CT) colors are distinguished from one another, and the letters Y, M, C, K, and CT are neglected when the yellow (Y), magenta (M), cyan (C), black (K), and transparent (CT) colors are not distinguished from one another. The simple "conveying direction" shall mean a conveying direction of the recording paper P.

The image forming unit 18 includes a photosensitive drum 20. A primary transfer roller 22, a cleaning device 24, a discharger 25, a charger 26, an LED array head 28, and a development device 30 are provided around the photosensitive drum 20 in the order of the rotating direction of the photosensitive drum 20.

An intermediate transfer member 31 is provided below the image forming units 18CT, 18Y, 18M, 18C, and 18K. The intermediate transfer member 31 includes a backup roller 34, tension rollers 32 and 33 provided along the process direction, and an endless intermediate transfer belt 36 entrained about the backup roller 34 and tension rollers 32 and 33.

The image forming units 18CT, 18Y, 18M, 18C, and 18K are arranged on a line in the order from the upstream side in the proceeding direction of the intermediate transfer belt 36 (arrow B direction). At this point, the primary transfer rollers 22CT, 22Y, 22M, 22C, and 22K are located at corresponding positions to the photosensitive drums 20CT, 20Y, 20M, 20C, and 20K respectively of the image forming units 18CT, 18Y, 18M, 18C, and 18K. The intermediate transfer belt 36 is provided between the primary transfer rollers 22CT, 22Y, 22M, 22C and the photosensitive drums 20CT, 20Y, 20M, 20C, and 20K.

A detailed positional relationship between the intermediate transfer member 31 and the image forming units 18CT, 18Y, 18M, 18C, and 18K will be described later.

The surface of the photosensitive drum 20 is evenly charged by the charging device 26, and line exposure is performed by the LED array head 28, whereby an electrostatic latent image is formed in the surface of the photosensitive drum 20. The development device 30 develops the electrostatic latent image to form the toner image. The toner image on the photosensitive drum 20 is primary-transferred onto the intermediate transfer belt 36 by electrostatic suction generated by a transfer bias applied to the primary transfer roller 22.

After the toner image is transferred to the intermediate transfer belt 36, the untransferred residual toner remaining on the photosensitive drum 20 is removed by the cleaning device 24. The surface of the photosensitive drum 20 is erased by the discharger 25, and the surface of the photosensitive drum 20 is charged again for the next image forming cycle by the charger 26.

In the image forming apparatus 10 of the exemplary embodiment, when the full-color image is formed, the same image forming process as noted above is performed in each of the image forming units 18CT, 18Y, 18M, 18C, and 18K at timing in which a difference in relative position is considered in the image forming units 18CT, 18Y, 18M, 18C, and 18K.

That is, the toner images formed in the photosensitive drums 20CT, 20Y, 20M, 20C, and 20K are transferred onto the intermediate transfer belt 36 by the primary transfer rollers 22CT, 22Y, 22M, 22C, and 22K respectively, and the transparent, yellow, magenta, cyan, and black toner images are sequentially transferred onto the intermediate transfer belt 36 while superposed on one another, thereby forming the full-color image.

A paper feed portion 14 is disposed on a side of the image forming portion 12. Paper feed cassettes 38 and 40 in which sheets of recording paper P are accommodated are provided in the paper feed portion 14. The recording paper P is fed to a color image forming portion 12 from one of the paper feed cassettes 38 and 40, and the recording paper P is delivered to a secondary transfer position C at predetermined timing by plural conveying rollers 44 of a conveying mechanism 42.

The secondary transfer position C shall mean a position where the intermediate transfer belt 36 is nipped between the backup roller 34 supporting the intermediate transfer belt 36 and a secondary transfer roller 48 pressed against the backup roller 34. The full-color toner image formed on the intermediate transfer belt 36 is transferred to the recording paper P, conveyed to the secondary transfer position C at predetermined timing, by the electrostatic suction generated by the transfer bias applied to the secondary transfer roller 48.

At this point, by the backup roller 34 and secondary transfer roller 48, the untransferred residual toner remaining on the intermediate transfer belt 36 which is not transferred in the recording paper P is squeezed by a cleaning blade 52 of an intermediate transfer belt cleaning device 50 provided near the tension roller 32, and the residual toner is removed from the surface of the intermediate transfer belt 36.

A conveying belt 58 entrained about two rollers 54 and 56 is provided on the downstream side of the secondary transfer position C. The recording paper P to which the full-color toner image on the intermediate transfer belt 36 is transferred is conveyed by the conveying belt 58 to a fixing device 60 which is of a heat treatment portion provided on the downstream side of the conveying belt 58.

A pressurizing roller 60A and a heating roller 60B of the fixing device 60 perform a fixing process to fix the toner image to the recording paper P. That is, the image is formed in the recording paper P. The recording paper P in which the image is formed is discharged to a discharge tray 57 provided outside the image forming apparatus 10.

The positional relationship between the image forming unit 18 and the intermediate transfer member 31 will be described below.

As described above, the transparent-toner, yellow, magenta, cyan, and black image forming units 18 are arranged in the order of transparent-toner, yellow, magenta, cyan, and black such as in the order from the upstream side in the process direction while the photosensitive drum 20 faces the intermediate transfer belt 36.

Figure 7:
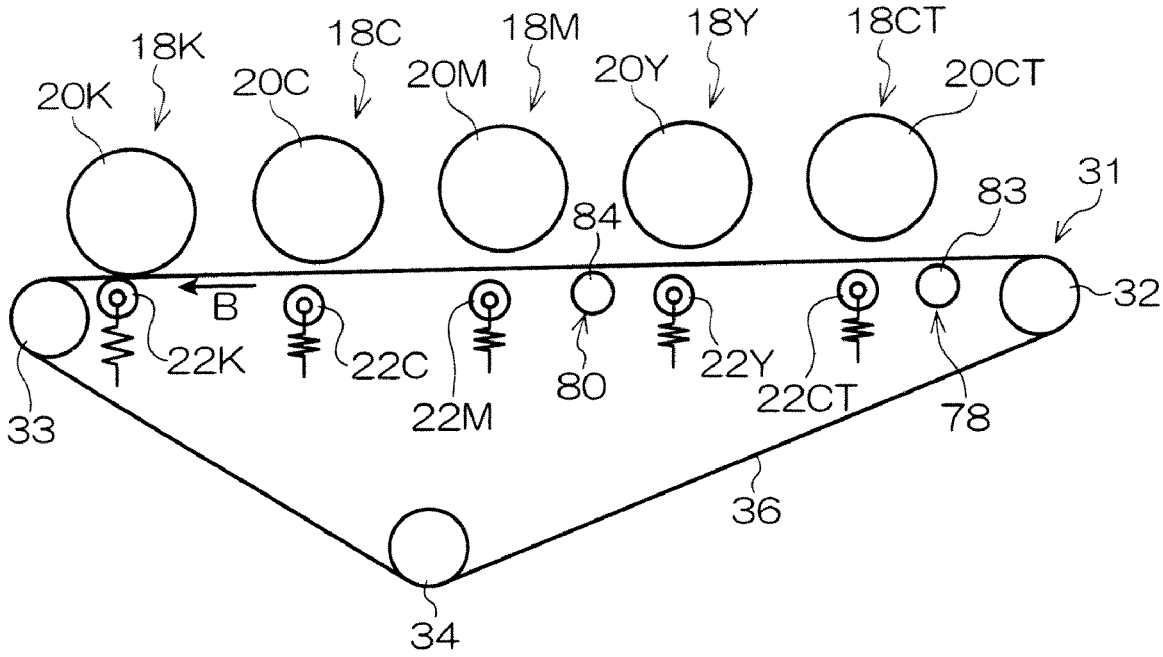
FIG. 7 is a schematic view showing a positional relationship between the intermediate transfer belt and the photosensitive drums when the monochrome image is formed in the plain paper.

As shown in FIG. 7, the black image forming unit 18K is arranged while the photosensitive drum 20K is brought into contact with the transfer surface (transfer surface, tensioned between the tension rollers 32 and 33, from which the toner image is transferred) of the intermediate transfer belt 36. The cyan, magenta, yellow, and transparent-toner image forming units 18C, 18M, 18Y, and 18CT are arranged such that gaps with the transfer surface of the intermediate transfer belt 36 are gradually increased in the order of the cyan, magenta, yellow, and transparent-toner image forming units 18C, 18M, 18Y, and 18CT. That is, an imaginable line connecting center shafts of the image forming units 18 is disposed so as to be nonparallel to the transfer surface of the intermediate transfer belt 36.

Figure 2:
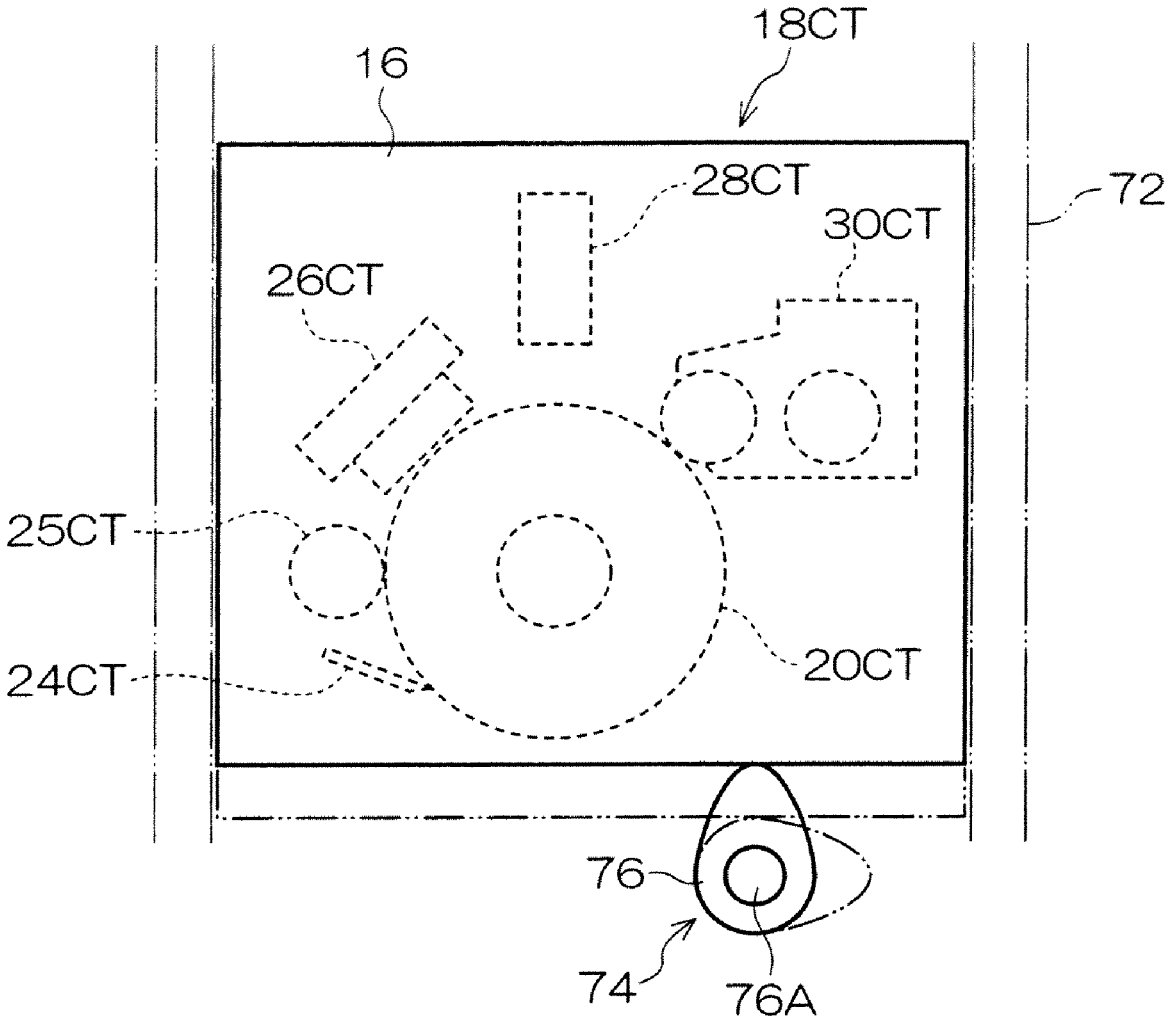
FIG. 2 is a schematic view showing a transparent-toner image forming unit incorporated into the image recording apparatus.

As shown in FIG. 2, the transparent-toner image forming unit 18CT includes a housing 16 in which the photosensitive drum 20CT, the cleaning device 24CT, the static eliminator 25, the charger 26CT, the LED array head 28CT, and the development device 30CT are positioned.

The housing 16 is supported in the image forming apparatus 10 while being able to be vertically moved along guide rails 72 provided in a main body of the image forming apparatus 10.

An eccentric cam 76 constituting a retracting member 74 abuts on a lower surface of the housing 16. A gear (not shown) is attached to a shaft 76A of the eccentric cam 76, the gear engages a driving gear attached to a motor shaft (not shown), and the eccentric cam 76 is rotated by rotation of a motor.

The photosensitive drum 20CT, cleaning device 24CT, discharger 25, charger 26CT, LED array head 28CT, and development device 30CT which are supported by the housing 16 are vertically moved when the eccentric cam 76 is rotated to vertically move the housing 16.

The transparent-toner image forming unit 18CT is configured to be able to be brought into contact with and separated from the intermediate transfer belt 36 (see FIG. 1). Whenever the formation of the transparent-toner image on the intermediate transfer belt 36 is required, the image forming unit 18CT is lowered to bring the photosensitive drum 20CT into contact with the intermediate transfer belt 36. When the formation of the transparent-toner image on the intermediate transfer belt 36 is not required, the image forming unit 18CT is raised to separate the photosensitive drum 20CT from the intermediate transfer belt 36.

The retracting member 74 is provided only in the transparent-toner image forming unit 18CT, while the yellow, magenta, cyan, and black image forming units 18Y, 18M, 18C, and 18K are fixed so as not to be vertically moved.

As shown in FIG. 1, a belt retracting member 78 is provided between the transparent-toner photosensitive drum 20CT (primary transfer roller 22CT) and the tension roller 32. The intermediate transfer belt 36 is entrained about the tension roller 32 located on the upstream side in the process direction, and the belt retracting member 78 is provided on the opposite side to the transfer surface of the intermediate transfer belt 36.

A belt retracting member 80 is provided between the yellow photosensitive drum 20Y (primary transfer roller 22Y) and the magenta photosensitive drum 20M (primary transfer roller 22M).

Because the belt retracting members 78 and 80 have the same configuration, the configuration of the belt retracting member 78 will be described by way of example.

Figure 3A:
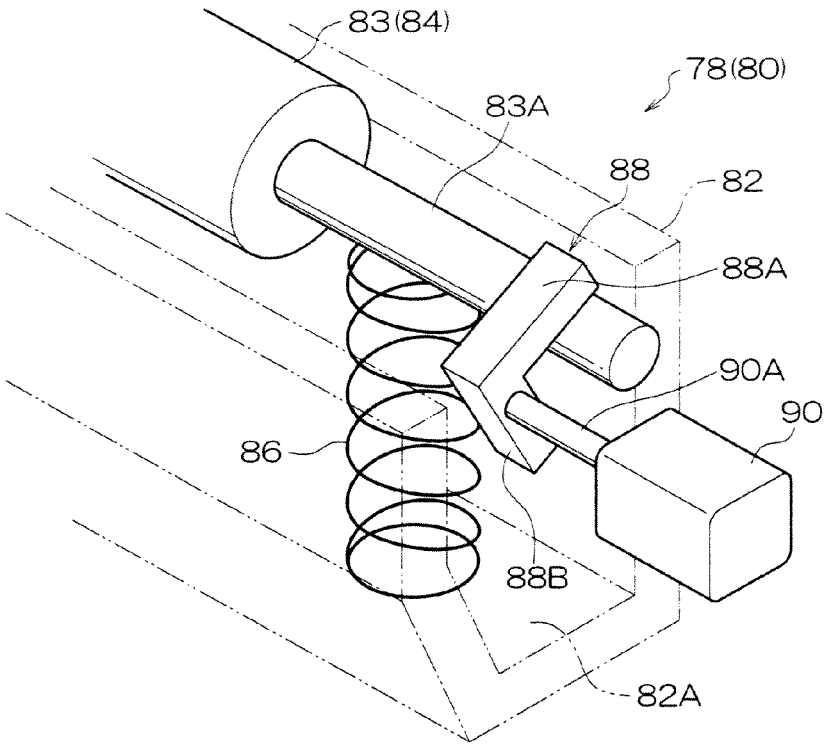
FIG. 3A and FIG. 3B are perspective view showing a belt retracting member incorporated into the image recording apparatus.
Figure 4A:
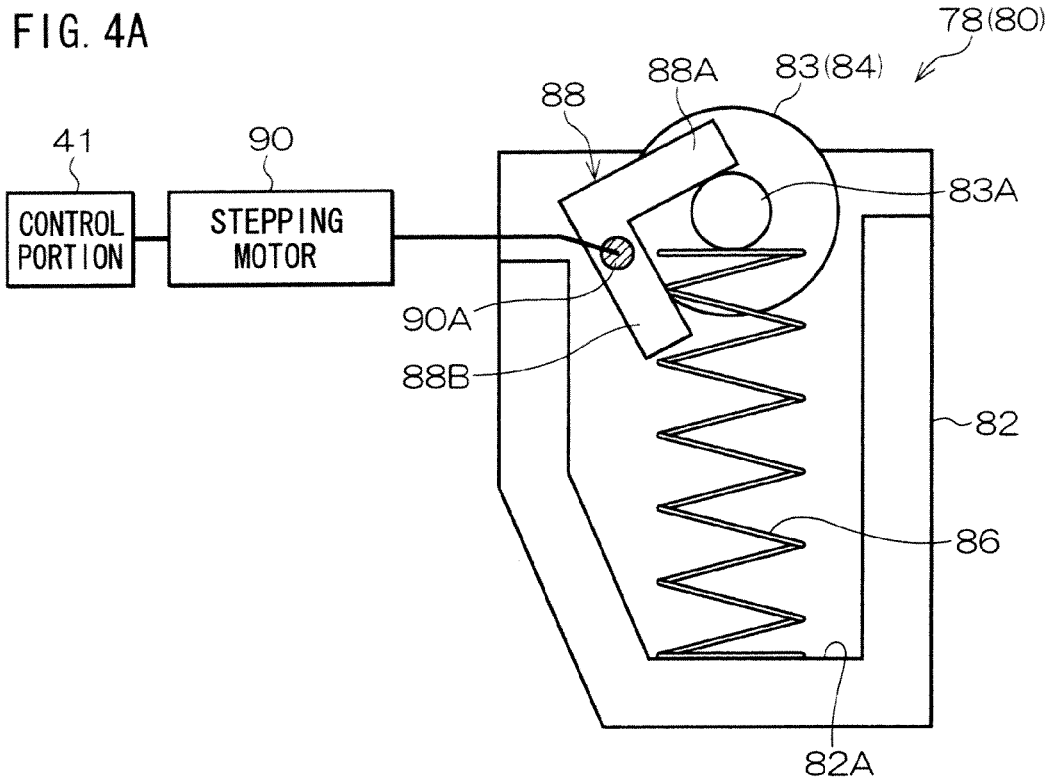
FIG. 4A and FIG. 4B are side view showing the belt retracting member incorporated into the image recording apparatus.

As shown in FIGS. 3A and 4A, the belt retracting member 78 includes a housing 82 provided along a longitudinal direction of the primary transfer roller 22 in the main body of the image forming apparatus 10 (see FIG. 1).

The housing 82 is formed in a substantial U-shape in section, and a long hole (not shown) is made along a vertical direction in a sidewall in the longitudinal direction of the housing 82. A shaft 83A of a roller member 83 is supported in the long hole, and the roller member 83 may vertically be moved in the housing 82 along the long hole while a part of the roller member 83 is exposed from an opening side of the housing 82.

A compression spring 86 is provided between the shaft 83A of the roller member 83 and a bottom portion 82A of the housing 82, and one end of the compression spring 86 abuts on the shaft 83A of the roller member 83. Therefore, the roller member 83 is biased upward.

As shown in FIG. 3A, in the shaft 83A of the roller member 83, a latching member 88 is provided outside the position where the shaft 83A is supported by the compression spring 86. The latching member 88 is formed in a substantial L-shape by one piece 88A and the other piece 88B. One piece 88A abuts on the shaft 83A of the roller member 83. The other piece 88B is extended toward a vertical direction from one piece 88A, and a shaft 90A of a stepping motor 90 is coupled to the other piece 88B.

As shown in FIG. 4A, a control portion 41 is connected to the stepping motor 90, and the latching member 88 is rotated about the shaft 90A when the stepping motor 90 is rotated by a signal from the control portion 41.

Figure 3B:
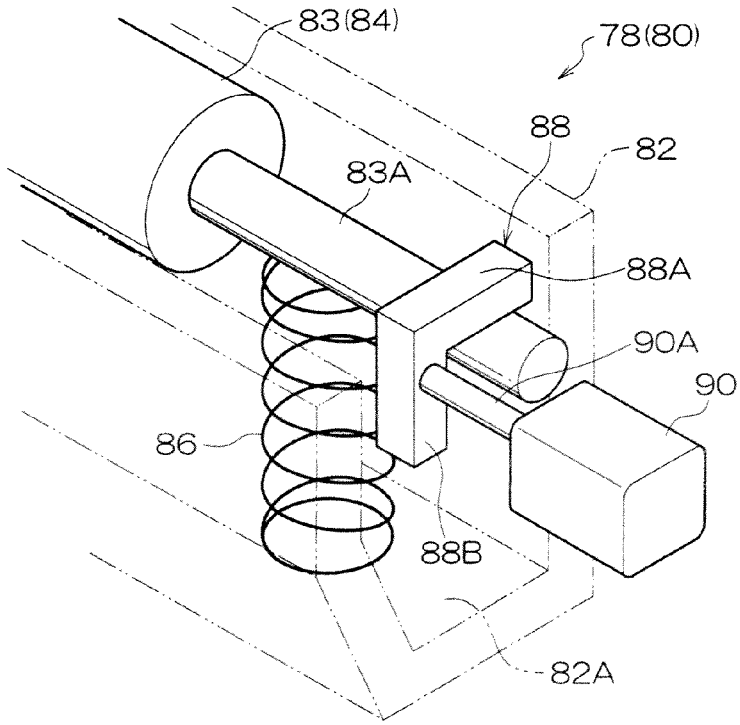
Figure 4B:
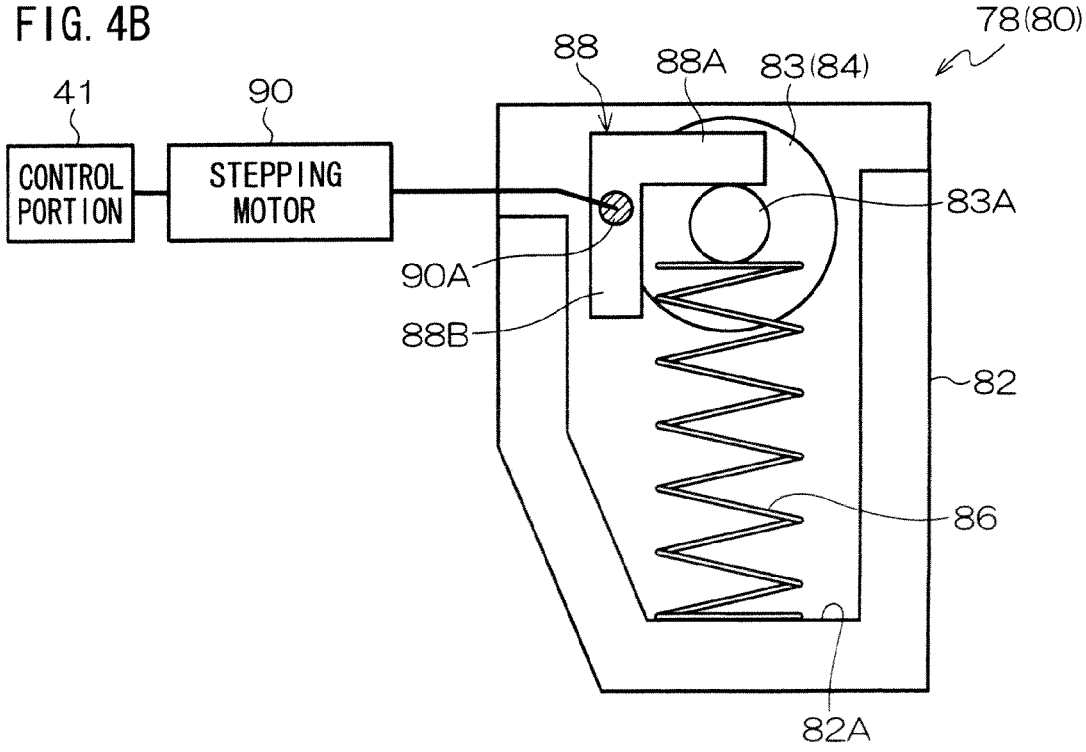

As shown in FIGS. 3B and 4B, when the latching member 88 is rotated clockwise, the shaft 83A of the roller member 83 is pressed by one piece 88A of the latching member 88, and the roller member 83 is pressed down toward the bottom portion of the housing 82.

As shown in FIGS. 3A and 4A, when the latching member 88 is rotated counterclockwise from the state shown in FIGS. 3B and 4B, one piece 88A of the latching member 88 is moved upward, the shaft 83A of the roller member 83 is pushed up to raise the roller member 83 by the biasing force of the compression spring 86.

Figure 6:
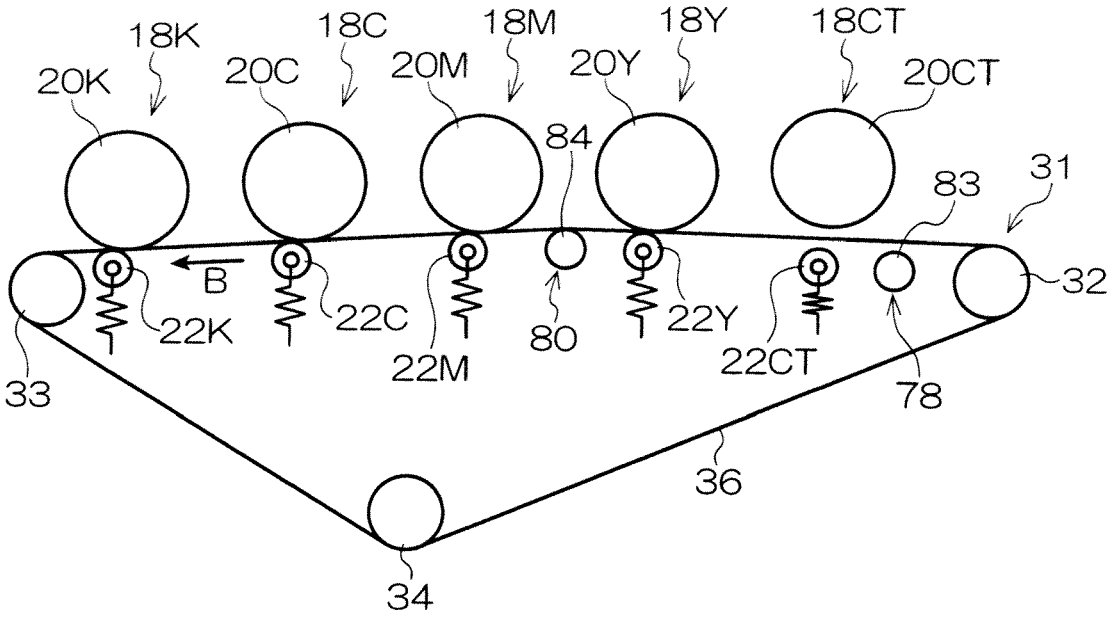
FIG. 6 is a schematic view showing a positional relationship between the intermediate transfer belt and the photosensitive drums when the full-color image is formed in plain paper.

When the roller member 83 of the belt retracting member 80 is raised, the roller member 83 is brought into contact with the backside of the intermediate transfer belt 36 to push up the intermediate transfer belt 36 between the yellow image forming unit 18Y and the magenta image forming unit 18M as shown in FIG. 6. This enables the transfer surface of the intermediate transfer belt 36 to be brought into contact with the yellow, magenta, and cyan photosensitive drums 20Y, 20M, and 20C.

Figure 5:
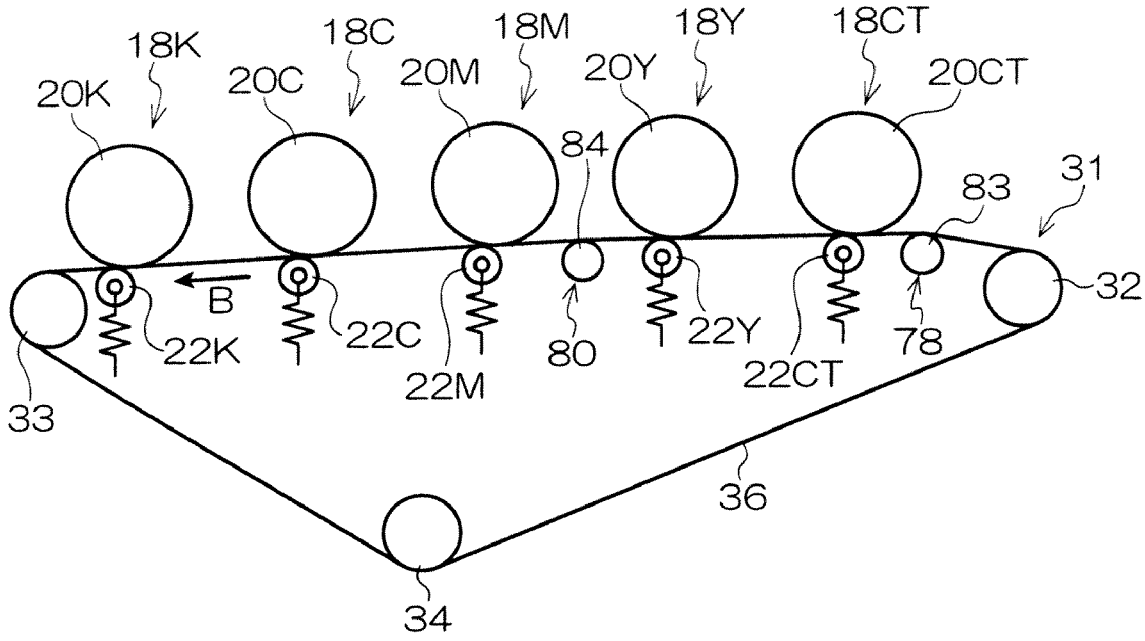
FIG. 5 is a schematic view showing a positional relationship between an intermediate transfer belt and photosensitive drums when a full-color image is formed in embossed paper.

When the roller member 83 of the belt retracting member 78 and the roller member 84 of the belt retracting member 80 are raised, the roller members 83 and 84 are brought into contact with the backside of the intermediate transfer belt 36 to push up the intermediate transfer belt 36 between the yellow image forming unit 18Y and the magenta image forming unit 18M and between the transparent-toner image forming unit 18CT and the yellow image forming unit 18Y as shown in FIG. 5. This enables the transfer surface of the intermediate transfer belt 36 to be brought into contact with the transparent-toner, yellow, magenta, and cyan photosensitive drums 20CT, 20Y, 20M, and 20C.

When the photosensitive drum 20 is not brought into contact with the intermediate transfer belt 36, the rotation of the photosensitive drum 20 is stopped such that the image forming unit 18 does not perform the image forming operation.

The primary transfer roller 22 provided on the other side of the intermediate transfer belt 36 than the side where the photosensitive drum 20 of the image forming unit 18 is provided has the same configuration as the belt retracting member 78 and 80 shown in FIGS. 3 and 4, and the primary transfer roller 22 may vertically be moved.

Therefore, when the intermediate transfer belt 36 is raised by the roller members 83 and 84 of the belt retracting members 78 and 80, the primary transfer roller 22 is also raised by the signal from the control portion 41 if needed.

A control panel (not shown) is provided in the image forming apparatus 10, and a user inputs an image forming mode. The user may select a full-color image forming mode and a monochrome image forming mode on the control panel. When the user inputs the image forming mode, the control portion 41 moves the belt retracting members 78 and 80, the primary transfer roller 22, and the transparent-toner image forming unit 18CT.

As shown in FIG. 1, sensors 46 and 47 are provided to detect smoothness of the transfer surface of the recording paper P. The sensors 46 and 47 are provided above the paper feed cassettes 38 and 40, and the sensors 46 and 47 are provided on the downstream side in the conveying direction of the recording paper P. Each of the sensors 46 and 47 includes a floodlighting sensor (not shown) which floodlights the transfer surface of the recording paper P and a light acceptance sensor (not shown) which accepts the light reflected from the transfer surface of the recording paper P. Each of the sensors 46 and 47 converts a light quantity accepted by the light acceptance sensor into a signal and outputs the signal.

The sensors 46 and 47 are connected to the control portion 41. When the light quantity detection signal is input to the control portion 41, the control portion 41 makes a determination of the smoothness of the transfer surface of the recording paper P according to the light quantity detection signal.

For example, the light quantity reflected by the transfer surface of the recording paper P is increased when the plain paper (the difference of about 10 μm between the recessed portion and the projected portion in the surface) having the high smoothness of the transfer surface is used as the recording paper P. The light quantity reflected by the transfer surface of the recording paper P is decreased when the embossed paper (special paper in which irregularity is made in the surface thereof, the difference of 40 μm to 60 μm between the recessed portion and the projected portion in the surface, and thickness of 100 μm to 260 μm) having the low smoothness of the transfer surface is used as the recording paper P. Therefore, the control portion 41 determines that the recording paper P is the plain paper when the light acceptance sensor accepts the large light quantity, and the control portion 41 determines that the recording paper P is the embossed paper when the light acceptance sensor accepts the small light quantity.

Operations in the image forming mode will be described below.

The case in which the embossed paper is used as the recording paper P to form the full-color image in the embossed paper will first be described. In this case, "FC+CT" is shown in the drawings because the full-color image (FC) is formed in the embossed paper using the transparent toner (CT).

The embossed paper which is of the recording paper P is accommodated in one of the paper feed cassettes 38 and 40, and the full-color image forming mode is input on the control panel.

At this point, as shown in FIG. 5, the roller member 84 of the belt retracting member 80 is raised, and the transfer surface of the intermediate transfer belt 36 is brought into contact with the yellow, magenta, and cyan photosensitive drums 20Y, 20M, and 20C. The roller member 83 of the belt retracting member 78 is also raised, and the transfer surface of the intermediate transfer belt 36 is brought into contact with the transparent-toner photosensitive drum 20CT. The transparent-toner, yellow, magenta, and cyan primary transfer rollers 22CT, 22Y, 22M, and 22C are raised.

Therefore, the transparent toner image is transferred onto the transfer surface of the intermediate transfer belt 36, and the yellow, magenta, cyan, and black toner images are sequentially transferred onto the transparent toner image. Then, the full-color toner image transferred onto the intermediate transfer belt 36 is transferred to the embossed paper conveyed to the secondary transfer position C.

The case in which the plain paper is used as the recording paper P to form the full-color image in the plain paper will be described. In this case, "FC" is shown in the drawings because the full-color image (FC) is formed in the plain paper without using the transparent toner (CT).

The plain paper which is of the recording paper P is accommodated in one of the paper feed cassettes 38 and 40, and the full-color image forming mode is input on the control panel.

At this point, the image forming operation of the transparent-toner image forming unit 18CT is stopped. As shown in FIG. 6, the roller member 84 of the belt retracting member 80 is raised, and the transfer surface of the intermediate transfer belt 36 is brought into contact with the yellow, magenta, and cyan photosensitive drums 20Y 20M, and 20C. The roller member 83 of the belt retracting member 78 is lowered, and the transfer surface of the intermediate transfer belt 36 is retracted from the transparent-toner photosensitive drum 20CT. The yellow, magenta, and cyan primary transfer rollers 22Y, 22M, and 22C are raised while the transparent toner primary transfer roller 22CT is lowered.

Therefore, the yellow, magenta, cyan, and black toner images are sequentially transferred onto the transfer surface of the intermediate transfer belt 36, and the full-color toner image transferred onto the intermediate transfer belt 36 is transferred to the plain paper conveyed to the secondary transfer position C.

The case in which the plain paper is used as the recording paper P to form the monochrome image in the plain paper will be described. In this case, "BW" is shown in the drawings because the monochrome image (BW) is formed in the embossed paper without using the transparent toner (CT).

The plain paper which is of the recording paper P is accommodated in one of the paper feed cassettes 38 and 40, and the monochrome image forming mode is input on the control panel.

At this point, the image forming operations of the transparent-toner, yellow, magenta, and cyan image forming units 18CT, 18Y, 18M, and 18C are stopped. As shown in FIG. 7, the roller member 84 of the belt retracting member 80 is lowered, and the transfer surface of the intermediate transfer belt 36 is retracted from the yellow, magenta, and cyan photosensitive drums 20Y, 20M, and 20C. The roller member 83 of the belt retracting member 78 is lowered, and the transfer surface of the intermediate transfer belt 36 is retracted from the transparent-toner photosensitive drum 20CT. The transparent-toner, yellow, magenta, and cyan primary transfer rollers 22CT, 22Y, 22M, and 22C are lowered.

Therefore, only the black toner image is transferred onto the transfer surface of the intermediate transfer belt 36, and the black toner image transferred onto the intermediate transfer belt 36 is transferred to the plain paper conveyed to the secondary transfer position C.

The case in which the embossed paper is used as the recording paper P to form the monochrome image in the embossed paper will be described. In this case. "BW+CT" is shown in the drawings because the monochrome image (BW) is formed in the embossed paper using the transparent toner (CT).

The embossed paper which is of the recording paper P is accommodated in one of the paper feed cassettes 38 and 40, and the monochrome image forming mode is input on the control panel.

Figure 8:
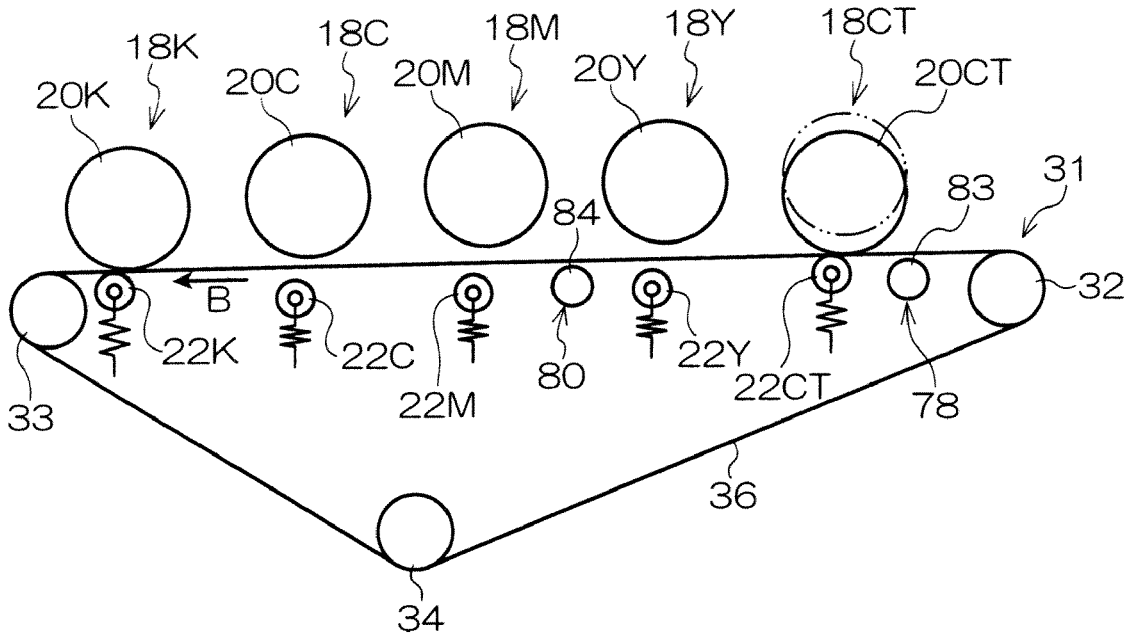
FIG. 8 is a schematic view showing a positional relationship between the intermediate transfer belt and the photosensitive drums when the monochrome image is formed in the embossed paper.

At this point, the image forming operations of the yellow, magenta, and cyan image forming units 18Y, 18M, and 18C are stopped. As shown in FIG. 8, the roller member 84 of the belt retracting member 80 is lowered, and the transfer surface of the intermediate transfer belt 36 is retracted from the yellow, magenta, and cyan photosensitive drums 20Y, 20M, and 20C. The transparent-toner image forming unit 18CT is lowered by the operation of the retracting member 74 while the roller member 83 of the belt retracting member 78 is lowered, and the transparent-toner photosensitive drum 20CT is brought into contact with the transfer surface of the intermediate transfer belt 36. The yellow, magenta, and cyan primary transfer rollers 22Y, 22M, and 22C are lowered while the transparent-toner primary transfer roller 22CT is raised.

Therefore, the transparent toner image is transferred to the transfer surface of the intermediate transfer belt 36, then the black toner image is transferred onto the transparent toner image, and the monochrome toner image transferred onto the intermediate transfer belt 36 is transferred to the embossed paper conveyed to the secondary transfer position C.

Action of the image forming apparatus of the exemplary embodiment will be described below.

In the case where the full-color image or the monochrome image is formed in the plain paper having the high surface smoothness, it is not necessary to transfer the transparent toner image onto the intermediate transfer belt 36. Therefore, the transparent-toner image forming unit 18CT is retracted from the intermediate transfer belt 36.

When compared with the case in which the transparent-toner image forming unit 18CT is always brought into contact with the intermediate transfer belt 36, the friction of the transparent-toner photosensitive drum 20CT may be suppressed to lengthen the lifetime of the photosensitive drum 20CT.

In the case where the monochrome image is formed in the recording paper P (embossed paper or plain paper), it is necessary to transfer only the black toner image or the transparent-toner and black toner images onto the intermediate transfer belt 36, and it is not necessary to transfer the yellow, magenta, and cyan toner images. Therefore, the yellow, magenta, and cyan image forming units 18Y, 18M, and 18C are retracted from the intermediate transfer belt 36 by the belt retracting members 78 and 80.

When compared with the case in which the yellow, magenta, and cyan image forming units 18Y, 18M, and 18C are always brought into contact with the intermediate transfer belt 36, the friction of the yellow, magenta, and cyan photosensitive drums 20Y, 20M, and 20C may be suppressed to lengthen the lifetimes of the yellow, magenta, and cyan photosensitive drums 20Y, 20M, and 20C.

Because the yellow, magenta, and cyan image forming units 18Y, 18M, and 18C are mot moved, the eccentricity or shift is hardly generated in the yellow, magenta, and cyan photosensitive drums 20Y, 20M, and 20C. Accordingly, the generation of the color shift is suppressed compared with the configuration in which the yellow, magenta, and cyan image forming units 18Y, 18M, and 18C are moved. Additionally, because a gear (not shown) provided on the side of the image forming unit 18 is not brought into contact with and separated from a driving source (driving gear) which is provided on the main body side of the image forming apparatus 10 to drive the image forming unit 18, the gear is hardly damaged.

When the color image is formed in the embossed paper, the belt retracting member 80 and the belt retracting member 78 bring the intermediate transfer belt 36 into contact with the yellow, magenta, and cyan photosensitive drums 20Y, 20M, and 20C and the transparent-toner photosensitive drum 20CT. When the monochrome image is formed in the embossed paper, the belt retracting member 80 retracts the intermediate transfer belt 36 from the yellow, magenta, and cyan photosensitive drums 20Y, 20M, and 20C, the belt retracting member 78 retracts the intermediate transfer belt 36 from the transparent-toner photosensitive drum 20CT, and the retracting member 74 brings the transparent-toner photosensitive drum 20CT into contact with the intermediate transfer belt 36. When the color image is formed in the plain paper, the belt retracting member 80 brings the intermediate transfer belt 36 into contact with the yellow, magenta, and cyan photosensitive drums 20Y, 20M, and 20C, and the belt retracting member 78 retracts the intermediate transfer belt 36 from the transparent-toner photosensitive drum 20CT. When the monochrome image is formed in the plain paper, the belt retracting member 80 retracts the intermediate transfer belt 36 from the yellow, magenta, and cyan photosensitive drums 20Y, 20M, and 20C, and the belt retracting member 78 retracts the intermediate transfer belt 36 from the transparent-toner photosensitive drum 20CT. That is, it is not necessary that the transparent-toner photosensitive drum 20CT be moved in a direction in which the transparent-toner photosensitive drum 20CT is retracted from the intermediate transfer belt 36, the moving amount of the transparent-toner photosensitive drum 20CT may be reduced.

When the image forming unit 18 performs the image forming operation while the photosensitive drum 20 is not brought into contact with the intermediate transfer belt 36, because the cleaning device 24 cleans the surface of the photosensitive drum 20 while the toner is not put on the surface of the photosensitive drum 20, the surface of the photosensitive drum 20 is easily abraded. Therefore, when the photosensitive drum 20 is not brought into contact with the intermediate transfer belt 36, the image forming operation of the image forming unit 18 is stopped. This enables the abrasion of the photosensitive drum 20 to be suppressed to lengthen the lifetime of the photosensitive drum 20.

The LED array head 28CT is positioned in the housing 16 to which the transparent-toner photosensitive drum 20CT is attached, and the photosensitive drum 20CT and the LED array head 28CT are moved together when the housing 16 is moved. Because an exposure length is not changed even if the photosensitive drum 20CT is moved, the density is not changed in the electrostatic latent image formed in the photosensitive drum 20CT. Accordingly, the generation of the unevenness may be suppressed in the image formed in the recording paper P.

The transparent-toner image forming unit 18CT is arranged on the upstream side in the process direction, and the transparent toner image is first transferred onto the intermediate transfer belt 36. In the case where the full-color image is formed on the transparent toner image, the yellow, magenta, cyan, and black toner images are sequentially transferred. Therefore, the five-layer toner image including the transparent, yellow, magenta, cyan, and black toner layers is formed on the intermediate transfer belt 36. At this point, the transparent toner image is formed in the bottom layer of the five-layer toner image. That is, because the transparent toner image is interposed between the color (yellow, magenta, and cyan) toner images and the intermediate transfer belt 36, the transfer property of the toner image is not lowered and the high-quality image is formed on the recording paper P, even if the embossed paper having the low smoothness of the transfer surface is used as the recording paper P onto which the toner image on the intermediate transfer belt 36 is transferred.

In the exemplary embodiment, the black image forming unit 18K is arranged on the lowermost stream side in the process direction. Therefore, a time (so-called FPOT (First Printout Time)) until the initial recording paper P is output since the image formation is completed to the initial recording paper P may be shortened in the monochrome image forming mode.

Experimental results for confirming the effect of the invention will be described below.

The experiment for a difference in color shift amount of the color image formed in the recording paper P is performed, in the conventional case in which the image forming unit 18 is moved to retract the photosensitive drum 20 from the transfer surface of the intermediate transfer belt 36, and in the case of the exemplary embodiment in which the belt retracting members 78 and 80 move the transfer surface of the intermediate transfer belt 36 to retract the transfer surface of the intermediate transfer belt 36 from the photosensitive drum 20.

Figure 9:
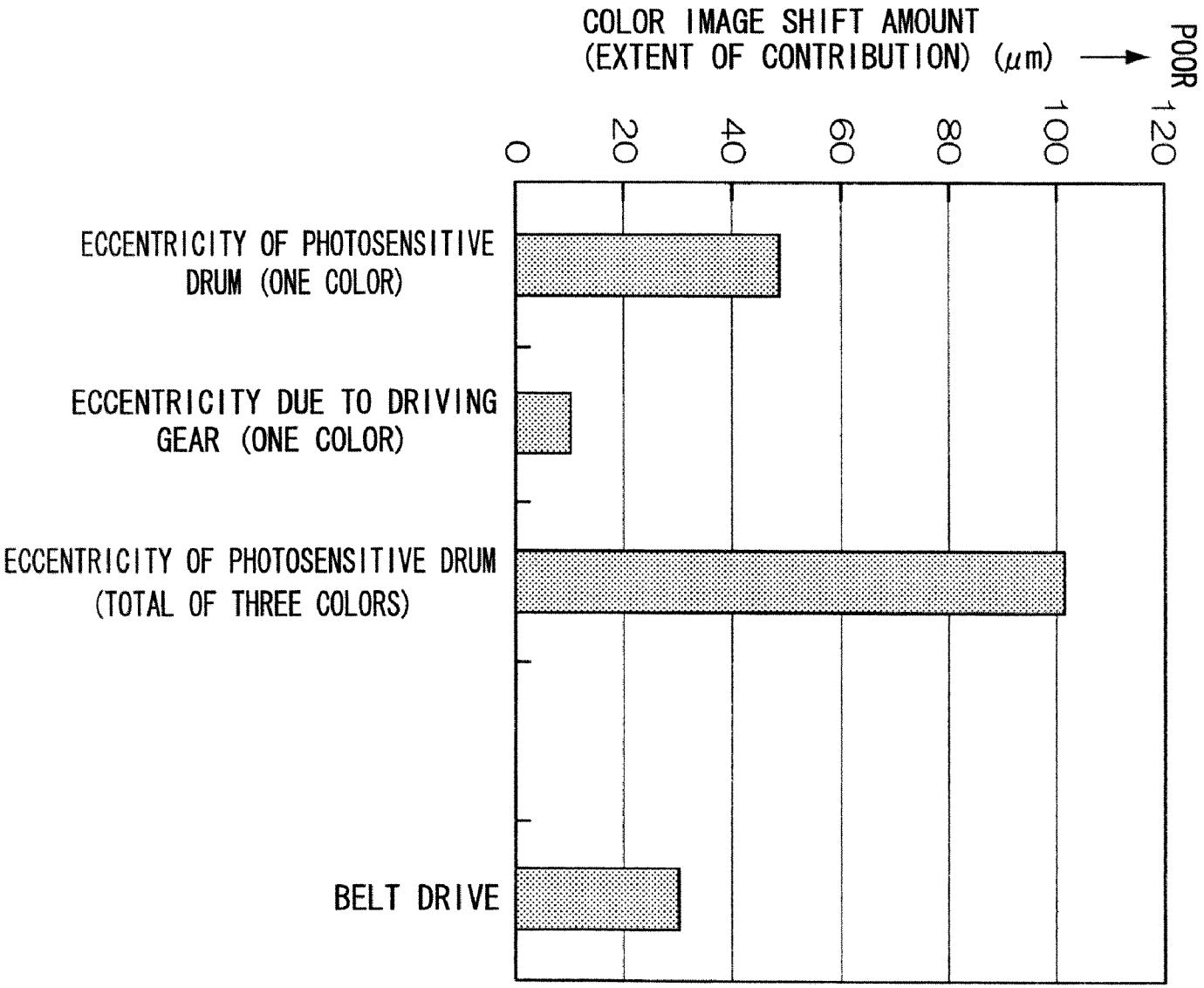
FIG. 9 is a graph showing a relationship between a color shift amount of the color image formed in recording paper P and a factor causing the color shift.

FIG. 9 is a graph showing a relationship between a color shift amount of the color image formed in the recording paper P and a factor causing the color shift. The color shift amount is measured from periodic shift (AC registration component) between the colors, which is partially generated within a page of the recording paper P, by the moving operation of the photosensitive drum 20 or intermediate transfer belt 36.

Figure 10:
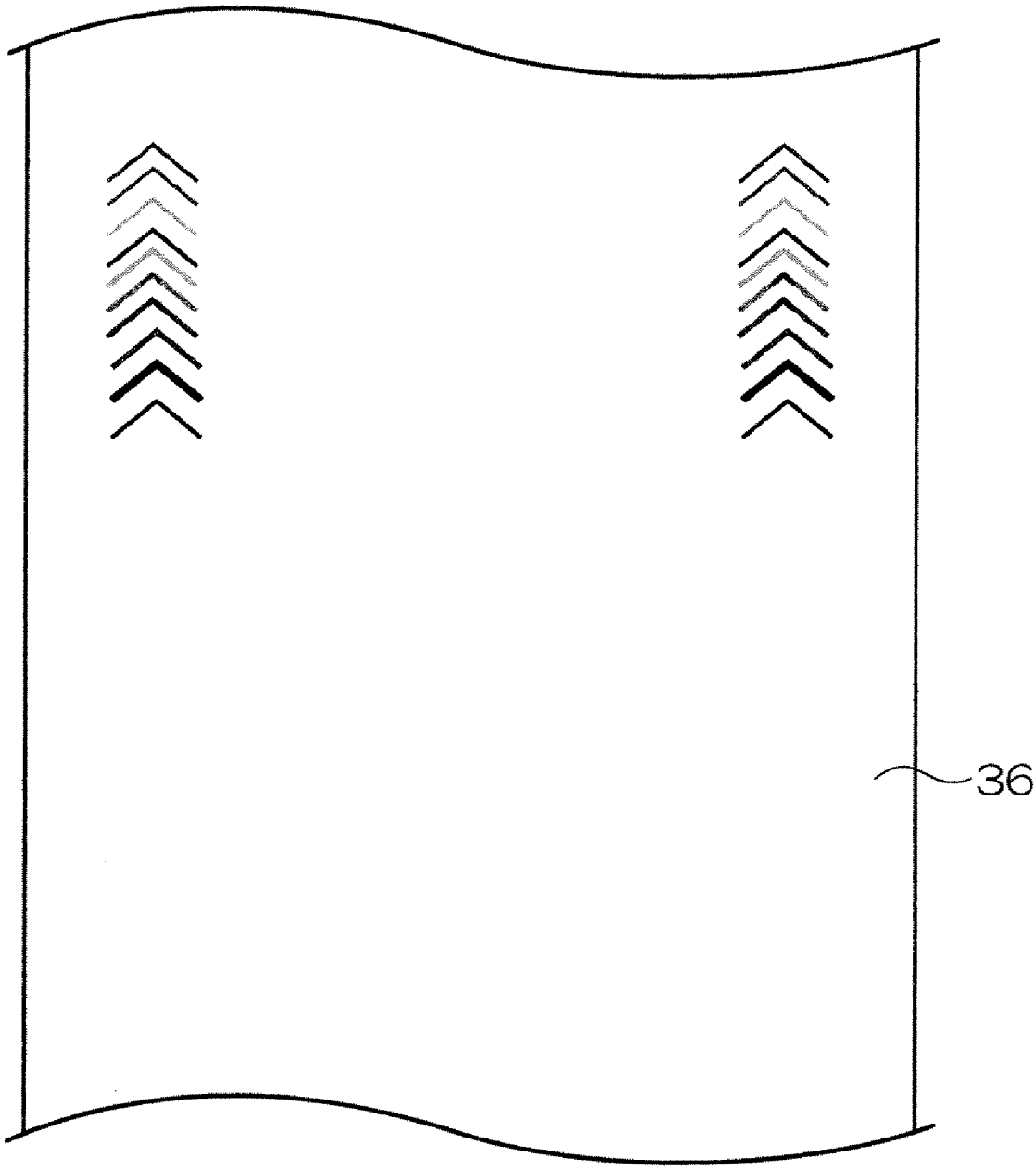
FIG. 10 is a plan view showing an image position detecting pattern for detecting relative position shift between two colors.

The relative misregistration between the two colors is measured by forming an image position detecting pattern (chevron pattern) shown in FIG. 10 on an outer circumferential surface of the intermediate transfer belt 36 to read passing timing of each pattern using a sensor (not shown).

As shown in FIG. 9, in the configuration in which the image forming unit 18 is moved to retract the photosensitive drum 20 from the transfer surface of the intermediate transfer belt 36, the color shift amount of the image becomes 50 μm due to the eccentricity of the one-color photosensitive drum 20, and the eccentricity caused by the driving gear of the one-color photosensitive drum 20 becomes 10 μm at that time. The color shift amount becomes 100 μm in total of the three color (except for the black) photosensitive drums 20.

On the contrary, in the exemplary embodiment, the color shift amount generated by driving the intermediate transfer belt 36 becomes 30 μm in the color image, when the belt retracting members 78 and 80 move the transfer surface of the intermediate transfer belt 36 to retract the transfer surface of the intermediate transfer belt 36 from the photosensitive drum 20.

Accordingly, when the belt retracting members 78 and 80 move the transfer surface of the intermediate transfer belt 36, compared with the conventional configuration in which the image forming unit 18 is moved, the color shift amount is largely reduced in the color image formed in the recording paper P to obtain the excellent image stability.

In the exemplary embodiment, the transparent-toner image forming unit 18CT (photosensitive drum 20CT) is retracted from the transfer surface of the intermediate transfer belt 36 by the retracting member 74. However, even if the color shift is generated in the transparent toner image, because the transparent toner is not visible, it is not necessary that the transparent toner image be accurately registered with other color toner images. Accordingly, even if the transparent-toner image forming unit 18CT is configured to be moved by the retracting member 74, there is substantially no risk of having an influence on the image stability.

Figure 11:
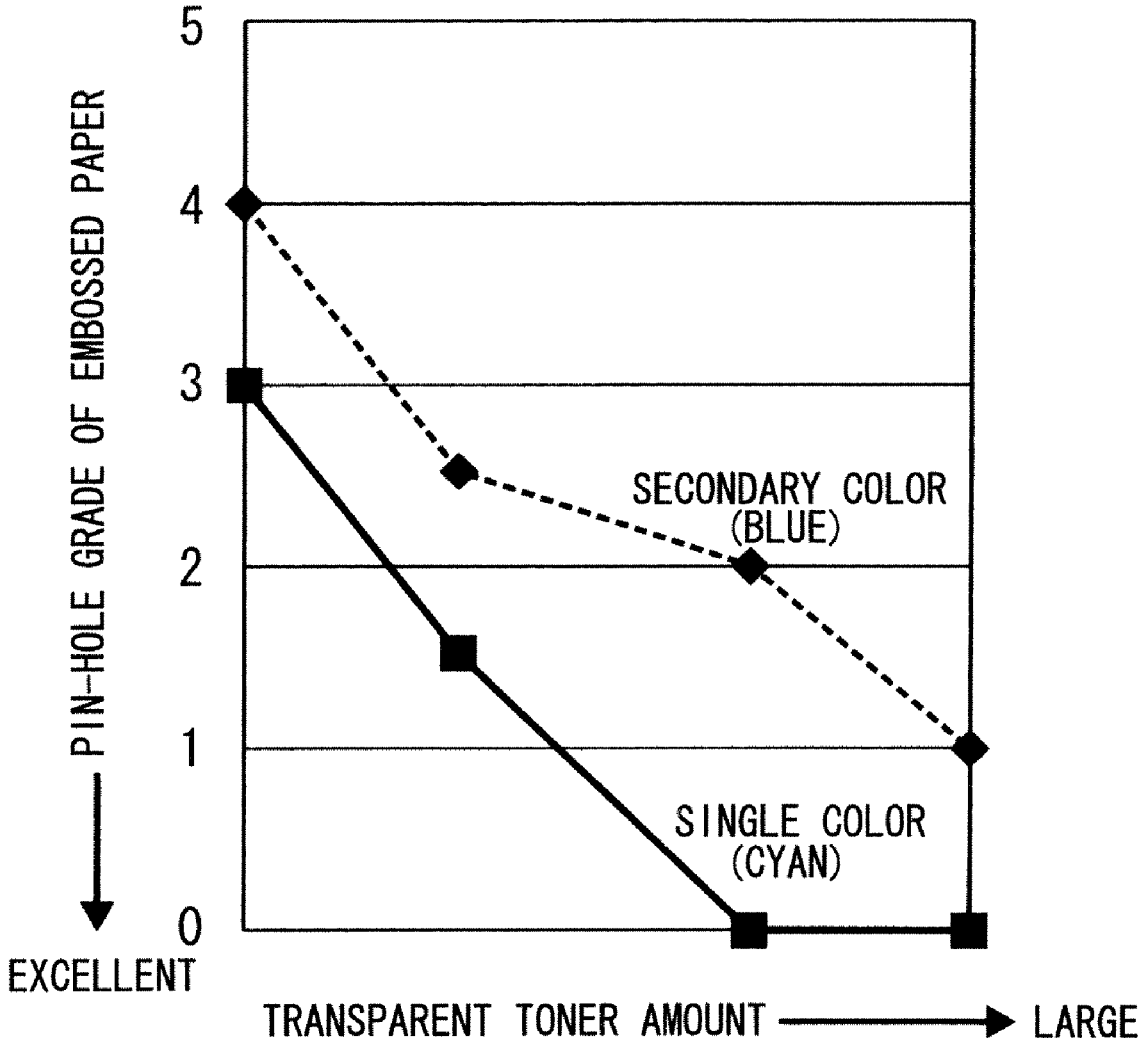
FIG. 11 is a graph showing a relationship between a transparent toner amount and a pin-hole grade of the image formed in the embossed paper.

FIG. 11 is a graph showing a relationship between the transparent toner amount and a pin-hole grade of the image formed in the embossed paper when the image is formed in the embossed paper (Leathac 66 (150 gsm)) using the transparent toner and color toners.

Referring to FIG. 11, a grade 0 indicates a state in which the pin-hole does not exist, a grade 1 indicates a state in which an embossed pattern is not distinguished as compared with a normal portion a grade 2 indicates a state in which the image is formed at the lowest permitted level although the embossed pattern is slightly observed, and a grade 3 and above indicate a state in which the image formation is not at permitted level because the embossed pattern is clearly observed.

As can be seen from the graph of FIG. 11, in both the single color and the secondary color, as the transparent toner amount is increased, the pin-hole level is decreased and the good image is formed in the embossed paper.

The lifetime of the photosensitive drum 20 is measured by performing a running test in which numerical values assumed in the actual usage of the photosensitive drum 20 in the market are used as a transparent toner usage rate (embossed paper usage rate) and a ratio of the monochrome image forming mode and the color image forming mode (use of transparent toner: no use of transparent toner=1:50, and monochrome image forming mode: color image forming mode=4:6).

A half-tone image formed in the recording paper P is observed, and the lifetime of the photosensitive drum 20 is judged from an image defect (generation of a streak or a white spot). The lifetime of the transparent-toner photosensitive drum 20 is judged by a combination with another photosensitive drum 20 (in the embodiment, cyan photosensitive drum 20C) in the midpoint of the running test.

Table 1 shows the number of sheets of the recording paper P when the lifetime of the photosensitive drum 20CT is ended. The transparent toner (embossed paper) is used once each 50 times in both the comparative example and the embodiment. In the comparative example, even if the transparent toner is not used, the transparent-toner image forming unit 18CT (photosensitive drum 20CT) is not retracted from the transfer surface of the intermediate transfer belt 36. In the exemplary embodiment, when transparent toner is not used, the transparent-toner image forming unit 18CT (photosensitive drum 20CT) is retracted from the transfer surface of the intermediate transfer belt 36, and the image forming operation is stopped.

TABLE 1

| | Lifetime of photosensitive drum 20CT (the number of sheets) |
|---|---|
| Comparative example | About 15,000 |
| Exemplary embodiment | 500,000 or more |

As shown in Table 1, in the comparative example, the lifetime of the photosensitive drum 20CT is ended when the image formation is performed for the about 15,000 sheets of recording paper P. In the exemplary embodiment, the image defect is not generated up to the 500,000 sheets of recording paper P.

Accordingly, when the transparent toner is not used, the transparent-toner image forming unit 18CT (photosensitive drum 20CT) is retracted from the transfer surface of the intermediate transfer belt 36, and the image forming operation is stopped, which allows the lifetime of the photosensitive drum 20CT to be largely lengthened.

Table 2 shows the number of sheets of the recording paper P when the lifetimes of the photosensitive drums 20Y, 20M, and 20C are ended. The ratio of the monochrome image forming mode and the color image forming mode is set to 4:6, and the transparent toner (embossed paper) is used one each 50 times. In the comparative example, during monochrome image forming mode and no use of the transparent toner, all the image forming units 18 (photosensitive drums 20) are not retracted from the transfer surface of the intermediate transfer belt 36. In the exemplary embodiment, during the monochrome image forming mode and no use of the transparent toner, the belt retracting member 78 and 80 retract the transfer surface of the intermediate transfer belt 36 such that the transfer surface of the intermediate transfer belt 36 is not brought into contact with the yellow, magenta, and cyan image forming units 18Y, 18M, and 18C (photosensitive drums 20Y, 20M, and 20C), and the image forming operations of the image forming units 18Y, 18M, and 18C are stopped. At the same time, the transparent-toner image forming unit 18CT (photosensitive drum 20CT) is retracted from the transfer surface of the intermediate transfer belt 36, and the image forming operation of the image forming unit 18CT is stopped.

TABLE 2

| | Lifetimes of photosensitive drums 20Y, 20M, and 20C (the number of sheets) |
|---|---|
| Comparative example | About 20,000 |
| Exemplary embodiment | About 50,000 |

As shown in Table 2, in the comparative example, the lifetimes of the photosensitive drums 20Y, 20M, and 20C are ended when the image formation is performed for the about 20,000 sheets of recording paper P. In the exemplary embodiment, the lifetimes of the photosensitive drums 20Y, 20M, and 20C are ended when the image formation is performed for the about 50,000 sheets of recording paper P.

Accordingly, during the monochrome image formation, the photosensitive drums 20Y, 20M, and 20C are retracted from the transfer surface of the intermediate transfer belt 36, and the image forming operations of the image forming units 18Y, 18M, and 18C are stopped, which allows the lifetimes of the photosensitive drums 20Y, 20M, and 20C to be lengthened about 2.5 times.

In the configuration of the exemplary embodiment, the transfer surface of the intermediate transfer belt 36 is brought into contact with and separated from the transparent-toner, yellow, magenta, and cyan photosensitive drums 20CT, 20Y, 20M, and 20C by the belt retracting member 78 provided between the tension roller 32 and the transparent-toner photosensitive drum 20CT and the belt retracting member 80 provided between the yellow photosensitive drum 20Y and the magenta photosensitive drum 20M. Alternatively, the transfer surface of the intermediate transfer belt 36 may be brought into contact with and separated from the photosensitive drum 20 by a configuration except for the exemplary embodiment.

For example, the belt retracting member 78 may be provided between the tension roller 32 and the transparent-toner photosensitive drum 20CT while the belt retracting member 80 may be provided between the transparent-toner photosensitive drum 20CT and the yellow photosensitive drum 20Y, between the magenta photosensitive drum 20M and the cyan photosensitive drum 20C, or between the cyan photosensitive drum 20C and the black photosensitive drum 20K.

As shown in FIGS. 12A to 12D, the belt retracting member 78 may be provided between the transparent-toner photosensitive drum 20CT and the yellow photosensitive drum 20Y while the belt retracting member 80 may be provided between the magenta photosensitive drum 20M and the cyan photosensitive drum 20C.

Figure 12A:
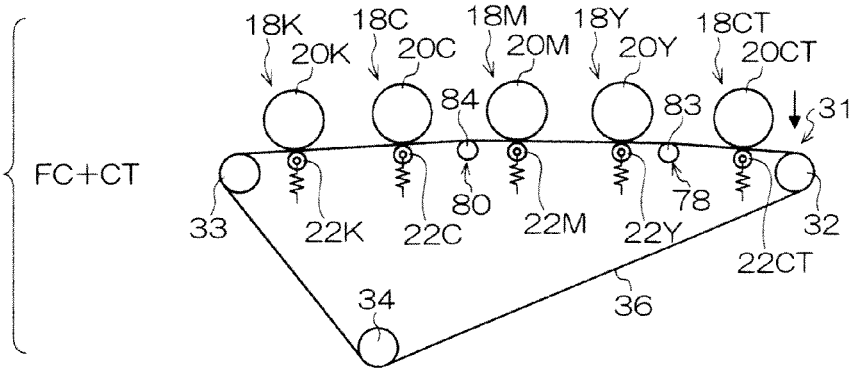
FIG. 12A is a schematic view showing a positional relationship between an intermediate transfer belt and photosensitive drums when the full-color image is formed using the embossed paper in an image forming apparatus according to another embodiment.

In the case where the full-color image is formed in the embossed paper (FC+CT), the transparent-toner image forming unit 18CT is lowered while the roller members 83 and 84 of the belt retracting members 78 and 80 are raised as shown in FIG. 12A. Therefore, the transfer surface of the intermediate transfer belt 36 is brought into contact with the yellow, magenta, and cyan photosensitive drums 20Y, 20M, and 20C, and the transparent-toner photosensitive drum 20CT is brought into contact with the transfer surface of the intermediate transfer belt 36.

Figure 12B:
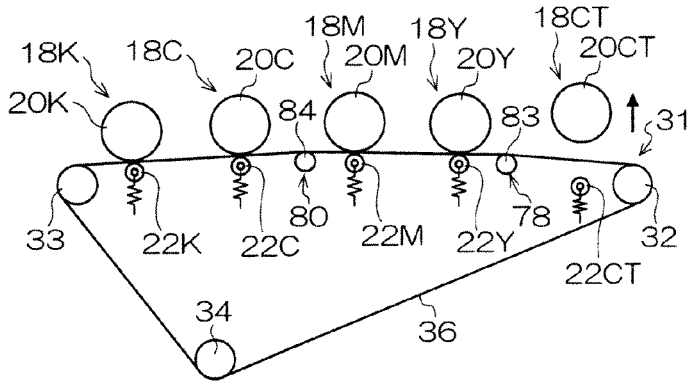
FIG. 12B is a schematic view showing a positional relationship between the intermediate transfer belt and the photosensitive drums when the full-color image is formed using the plain paper in the image forming apparatus according to another embodiment of the invention.

In the case where the full-color image is formed in the plain paper (FC), the transparent-toner image forming unit 18CT is raised while the roller members 83 and 84 of the belt retracting members 78 and 80 are raised as shown in FIG. 12B. Therefore, the transfer surface of the intermediate transfer belt 36 is brought into contact with the yellow, magenta, and cyan photosensitive drums 20Y, 20M, and 20C, and the transparent-toner photosensitive drum 20CT is retracted from the transfer surface of the intermediate transfer belt 36.

Figure 12C:
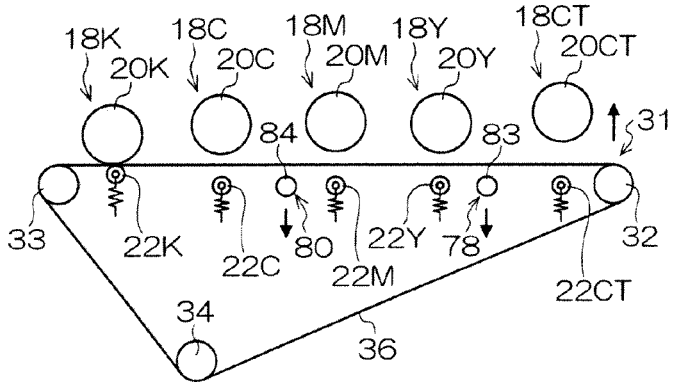
FIG. 12C is a schematic view showing a positional relationship between the intermediate transfer belt and the photosensitive drums when the monochrome image is formed using the plain paper in the image forming apparatus according to another embodiment.

In the case where the monochrome image is formed in the plain paper (BW), the transparent-toner image forming unit 18CT is raised while the roller members 83 and 84 of the belt retracting members 78 and 80 are lowered as shown in FIG. 12C. Therefore, the transfer surface of the intermediate transfer belt 36 is retracted from the yellow, magenta, and cyan photosensitive drums 20Y, 20M, and 20C, and the transparent-toner photosensitive drum 20CT is retracted from the transfer surface of the intermediate transfer belt 36.

Figure 12D:
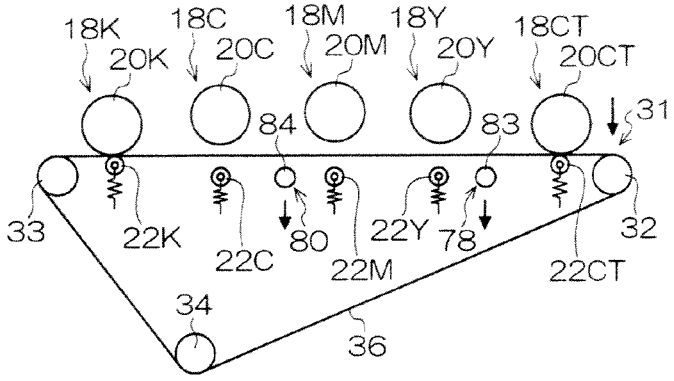
FIG. 12D is a schematic view showing a positional relationship between the intermediate transfer belt and the photosensitive drums when the monochrome image is formed using the embossed paper in the image forming apparatus according to another embodiment.

In the case where the monochrome image is formed in the embossed paper (BW+CT), the transparent-toner image forming unit 18CT is lowered while the roller members 83 and 84 of the belt retracting members 78 and 80 are lowered as shown in FIG. 12D. Therefore, the transfer surface of the intermediate transfer belt 36 is retracted from the yellow, magenta, and cyan photosensitive drums 20Y, 20M, and 20C, and the transparent-toner photosensitive drum 20CT is brought into contact with the transfer surface of the intermediate transfer belt 36.

In the above embodiment, the belt retracting member 78 may be provided between the transparent-toner photosensitive drum 20CT and the yellow photosensitive drum 20Y while the belt retracting member 80 may be provided between the yellow photosensitive drum 20Y and magenta photosensitive drum 20M or between the cyan photosensitive drum 20C and the black photosensitive drum 20K.

In the configuration of the embodiment, the transparent-toner, yellow, magenta, cyan, and black image forming units 18CT, 18Y, 18M, 18C, and 18K are sequentially provided from the upstream side in the process direction. Alternatively, as shown in FIG. 13, in the case where the transparent toner, black, cyan, magenta, and yellow image forming units 18CT, 18K, 18C, 18M, and 18Y are sequentially provided from the upstream side in the process direction, a tension roller 92 may be provided between the transparent-toner photosensitive drum 20CT and the black photosensitive drum 20K while the belt retracting member 78 is provided between the yellow photosensitive drum 20Y and the tension roller 33 located on the downstream side in the process direction.

Figure 13A:
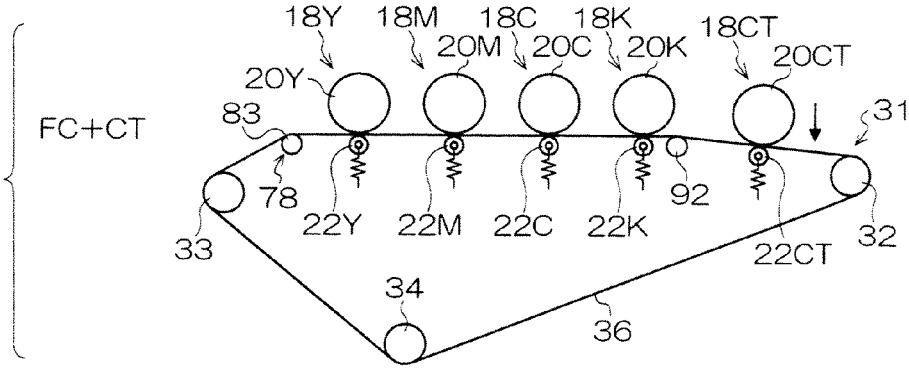
FIG. 13A is a schematic view showing a positional relationship between an intermediate transfer belt and photosensitive drums when the full-color image is formed using the embossed paper in an image forming apparatus according to still another embodiment.

In the case where the full-color image is formed in the embossed paper (FC+CT), the transparent-toner image forming unit 18CT is lowered while the roller member 83 of the belt retracting member 78 is raised as shown in FIG. 13A. Therefore, the transfer surface of the intermediate transfer belt 36 is brought into contact with the yellow, magenta, cyan, and black photosensitive drums 20Y, 20M, 20C, and 20K, and the transparent-toner photosensitive drum 20CT is brought into contact with the transfer surface of the intermediate transfer belt 36.

Figure 13B:
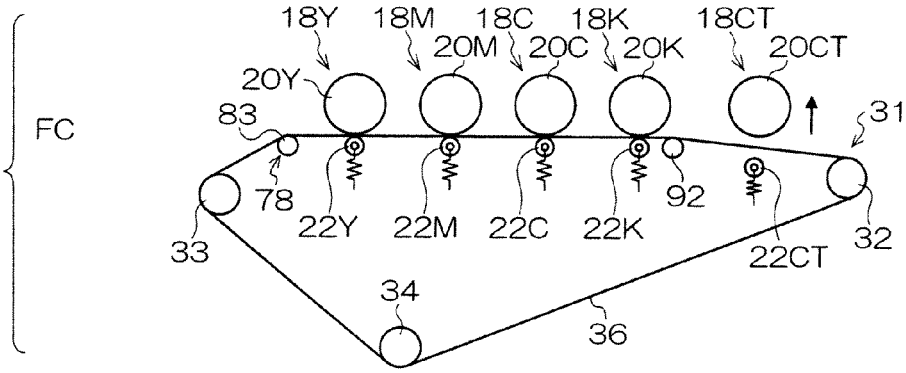
FIG. 13B is a schematic view showing a positional relationship between the intermediate transfer belt and the photosensitive drums when the full-color image is formed using the plain paper in the image forming apparatus according to still another embodiment.

In the case where the full-color image is formed in the plain paper (FC), the transparent-toner image forming unit 18CT is raised while the roller member 83 of the belt retracting member 78 is raised as shown in FIG. 13B. Therefore, the transfer surface of the intermediate transfer belt 36 is brought into contact with the yellow, magenta, cyan, and black photosensitive drums 20Y, 20M, 20C, and 20K, and the transparent-toner photosensitive drum 20CT is retracted from the transfer surface of the intermediate transfer belt 36.

Figure 13C:
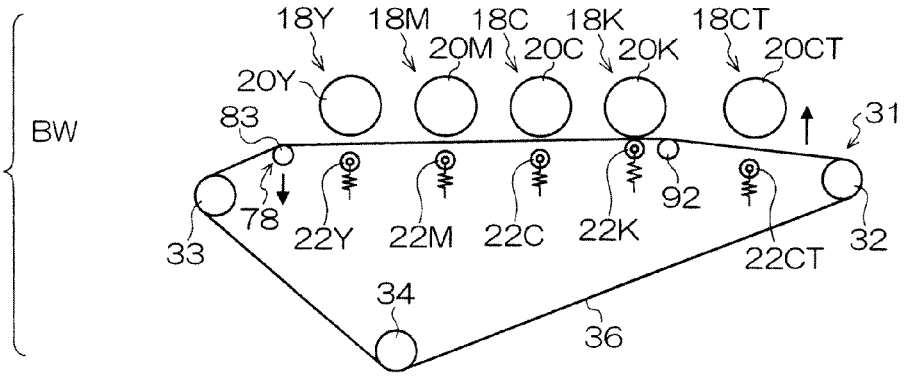
FIG. 13C is a schematic view showing a positional relationship between the intermediate transfer belt and the photosensitive drums when the monochrome image is formed using the plain paper in the image forming apparatus according to still another embodiment.

In the case where the monochrome image is formed in the plain paper (BW), the transparent-toner image forming unit 18CT is raised while the roller member 83 of the belt retracting member 78 is lowered as shown in FIG. 13C. Therefore, the transfer surface of the intermediate transfer belt 36 is retracted from the yellow, magenta, and cyan photosensitive drums 20Y, 20M, and 20C, and the transparent-toner photosensitive drum 20CT is retracted from the transfer surface of the intermediate transfer belt 36.

Figure 13D:
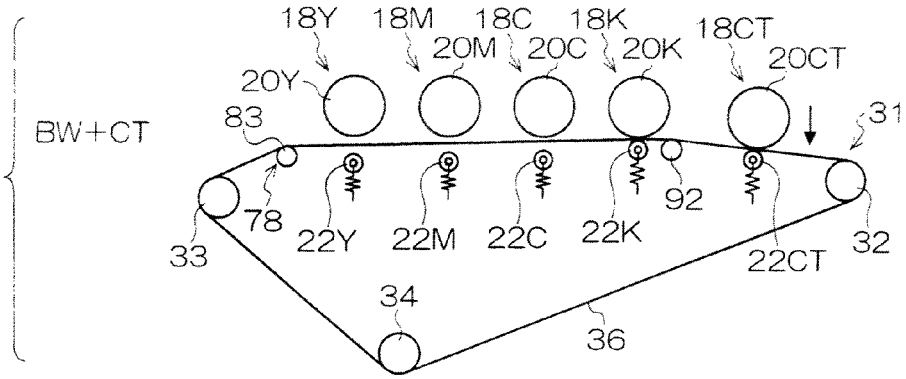
FIG. 13D is a schematic view showing a positional relationship between the intermediate transfer belt and the photosensitive drums when the monochrome image is formed using the embossed paper in the image forming apparatus according to still another embodiment.

In the case where the monochrome image is formed in the embossed paper (BW+CT), the transparent-toner image forming unit 18CT is lowered while the roller member 83 of the belt retracting member 78 is lowered as shown in FIG. 13D. Therefore, the transfer surface of the intermediate transfer belt 36 is retracted from the yellow, magenta, and cyan photosensitive drums 20Y, 20M, and 20C, and the transparent-toner photosensitive drum 20CT is brought into contact with the transfer surface of the intermediate transfer belt 36.

In the configuration of the exemplary embodiment, the transfer surface of the intermediate transfer belt 36 is brought into contact with and retracted from the transparent-toner, yellow, magenta, and cyan photosensitive drums 20CT, 20Y, 20M, and 20C by the belt retracting members 78 and 80. Alternatively, as shown in FIG. 14, the belt retracting member is not provided, however the tension roller 32, located on the upstream side in the process direction, about which the intermediate transfer belt 36 is entrained may vertically be moved to retract the transfer surface of the intermediate transfer belt 36 from the yellow, magenta, and cyan photosensitive drums 20Y, 20M, and 20C.

Figure 14A:
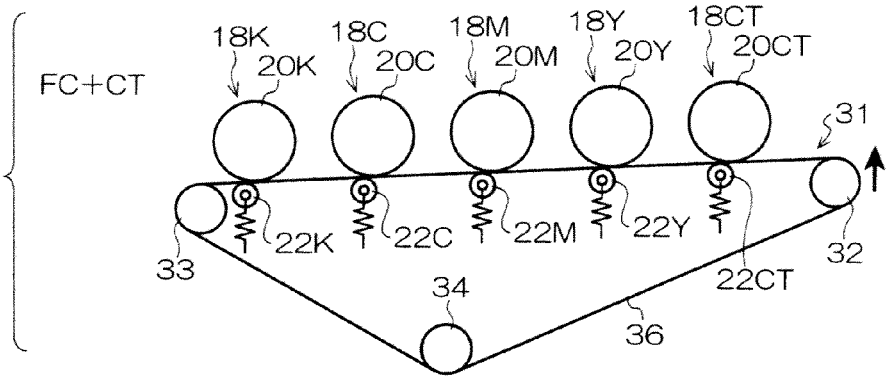
FIG. 14A is a schematic view showing a positional relationship between an intermediate transfer belt and photosensitive drums when the full-color image is formed using the embossed paper in an image forming apparatus according to still another embodiment.

In the case where the full-color image is formed in the embossed paper (FC+CT), the tension roller 32 is raised (tension roller 33 is set to a reference position shaft, and the tension roller 32 is moved counterclockwise in FIG. 14A) as shown in FIG. 14A. Therefore, the transfer surface of the intermediate transfer belt 36 is brought into contact with the transparent-toner, yellow, magenta, cyan, and black photosensitive drums 20CT, 20Y, 20M, 20C, and 20K.

Figure 14B:
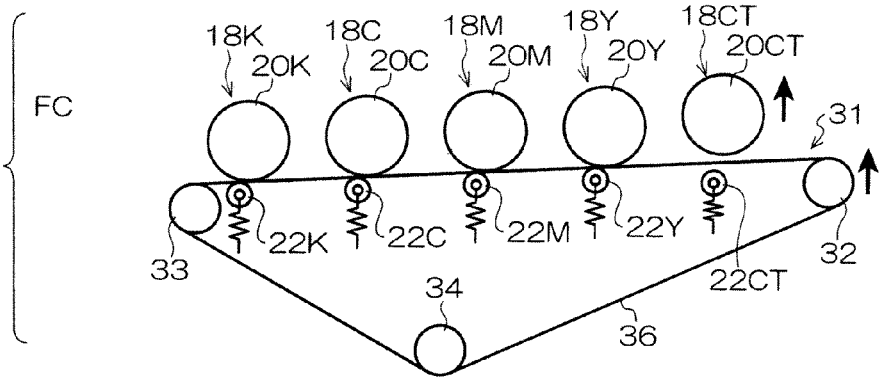
FIG. 14B is a schematic view showing a positional relationship between the intermediate transfer belt and the photosensitive drums when the full-color image is formed using the plain paper in the image forming apparatus according to still another embodiment.

In the case where the full-color image is formed in the plain paper (FC), the transparent-toner image forming unit 18CT is raised while the tension roller 32 is raised as shown in FIG. 14B. Therefore, the transfer surface of the intermediate transfer belt 36 is brought into contact with the yellow, magenta, cyan, and black photosensitive drums 20Y, 20M, 20C, and 20K, and the transparent-toner photosensitive drum 20CT is retracted from the transfer surface of the intermediate transfer belt 36.

Figure 14C:
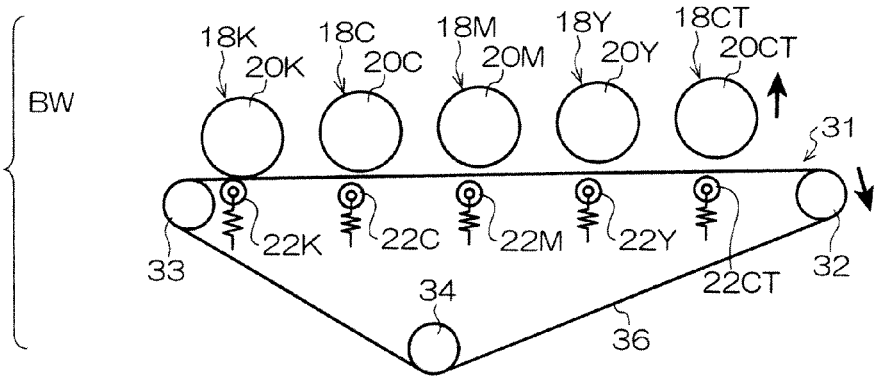
FIG. 14C is a schematic view showing a positional relationship between the intermediate transfer belt and the photosensitive drums when the monochrome image is formed using the plain paper in the image forming apparatus according to still another embodiment.

In the case where the monochrome image is formed in the plain paper (BW), the transparent-toner image forming unit 18CT is raised while tension roller 32 is lowered (tension roller 33 is set to the reference position shaft, and the tension roller 32 is moved clockwise in FIG. 14C) as shown in FIG. 14C. Therefore, the transfer surface of the intermediate transfer belt 36 is retracted from the transparent-toner, yellow, magenta, and cyan photosensitive drums 20CT, 20Y, 20M, and 20C.

Figure 14D:
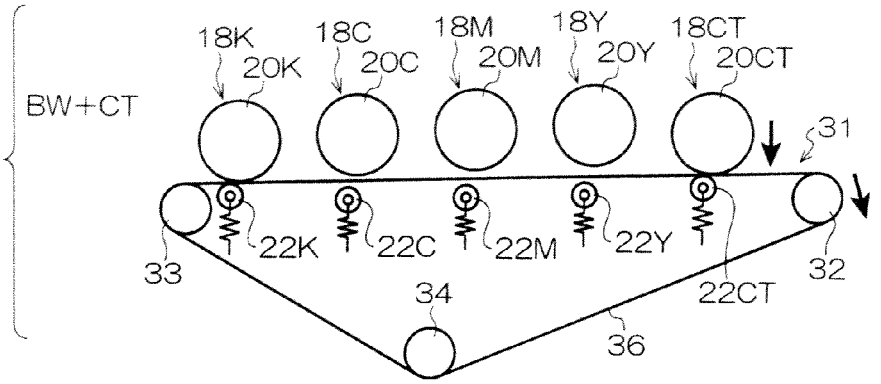
FIG. 14D is a schematic view showing a positional relationship between the intermediate transfer belt and the photosensitive drums when the monochrome image is formed using the embossed paper in the image forming apparatus according to still another embodiment.

In the case where the monochrome image is formed in the embossed paper (BW+CT), transparent-toner image forming unit 18CT is lowered while the tension roller 32 is lowered as shown in FIG. 14D. Therefore, the transfer surface of the intermediate transfer belt 36 is retracted from the yellow, magenta, and cyan photosensitive drums 20Y, 20M, and 20C, and the transparent-toner photosensitive drum 20CT is brought into contact with the transfer surface of the intermediate transfer belt 36.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a transparent image forming unit having a transparent image carrier at which a transparent toner image is formed;

a plurality of color image forming units arranged at a downstream side in a process direction of the transparent image forming unit, the color image forming units having color image carriers at which yellow, magenta, and cyan color toner images are formed respectively;

a black image forming unit arranged between the transparent image forming unit and the color image forming unit or at the downstream side in the process direction of the color image forming units, the black image forming unit having a black image carrier at which a black toner image is formed;

an intermediate transfer member to which the toner images formed on the transparent image carrier, the color image carriers, and the black image carrier, are transferred;

a retracting mechanism that brings the transparent image carrier into contact with the intermediate transfer member and separates the transparent image carrier from the intermediate transfer member; and a moving mechanism that brings the intermediate transfer member into contact with the color image carrier and separates the intermediate transfer member from the color image carriers, wherein the retracing mechanism makes the transparent image forming unit move, thereby contacting the transparent image carrier with the intermediate transfer member and separating the transparent image carrier from the intermediate transfer member; and the retracting mechanism and the moving mechanism are not mechanically interconnected with each other.

2. The image forming apparatus of claim 1, wherein the black image forming unit is provided at the downstream side in the process direction of the color image forming unit, the intermediate transfer member is formed by a plurality of rollers and an endless belt entrained about the rollers, and the moving mechanism is provided between the plurality of color image carriers, and the moving mechanism has a first belt retracting member that brings the endless belt into contact with the color image carriers and separates the endless belt from the color image carriers.

3. The image forming apparatus of claim 2, wherein the moving mechanism is provided at an upstream side in the process direction of the transparent image carrier, and the moving mechanism has a second belt retracting member that brings the endless belt into contact with the transparent image carrier and separates the endless belt from the transparent image carrier.

4. The image forming apparatus of claim 2, wherein a process of the toner image forming of the transparent image forming unit and the color image forming unit are stopped when the transparent image carrier and the color image carriers are not in contact with the endless belt.

5. The image forming apparatus according to claim 1, wherein an exposure mechanism that forms an electrostatic latent image on the transparent image carrier is positioned in a case to which the transparent image carrier is attached, and the exposure mechanism is formed by LEDs arrayed in a longitudinal direction of the transparent image carrier.

6. The image forming apparatus according to claim 1, further comprising a detection unit that detects recording medium quality.

7. An image forming method for an image forming apparatus, comprising:

a transparent image forming unit having a transparent image carrier at which a transparent toner image is formed;

a plurality of color image forming units arranged at a downstream side in a process direction of the transparent image forming unit, the color image forming units having color image carriers at which yellow, magenta, and cyan color toner images are formed respectively;

a black image forming unit arranged at a downstream side in the process direction of the transparent image forming unit, the black image forming unit having a black image carrier at which a black toner image is formed;

an intermediate transfer member to which the toner images formed on the transparent image carrier, the color image carriers, and the black image carrier, are transferred;

a retracting mechanism that brings the transparent image carrier into contact with the intermediate transfer member and separates the transparent image carrier from the intermediate transfer member; and a moving unit that brings the intermediate transfer member into contact with the color image carrier and separates the intermediate transfer member from the color image carrier;

wherein the retracting mechanism makes the transparent image forming unit move, thereby contacting the transparent image carrier with the intermediate transfer member and separating the transparent image carrier from the intermediate transfer member; and the retracting mechanism and the moving mechanism are not mechanically interconnected with each other;

the method comprising, when forming a color image, the moving unit bringing the intermediate transfer member into contact with the color image carrier, and when forming a monochrome-mode image, the moving unit separating the intermediate transfer member from the color image carrier.

8. The image forming method according to claim 7, wherein the image forming apparatus further comprises a second moving unit and the second moving unit brings the intermediate transfer member into contact with the transparent image carrier and separates the intermediate transfer member from the transparent image carrier according to smoothness of transfer surface of a recording medium.

9. The image forming method according to claim 7, wherein the image forming apparatus further comprises a second moving unit and the second moving unit brings the intermediate transfer member into contact with the transparent image carrier when smoothness of transfer surface of a recording medium is low.

10. The image forming method according to claim 7, wherein the retracting mechanism brings the transparent image carrier into contact with the intermediate transfer member and separates the transparent image carrier from the intermediate transfer member according to smoothness of transfer surface of a recording medium.

11. The image forming method according to claim 7, wherein the retracting mechanism brings the transparent image carrier into contact with the intermediate transfer member when smoothness of transfer surface of a recording medium is low.

12. The image forming method according to claim 7, wherein a transparent toner image is formed on the transparent toner carrier when smoothness of transfer surface of a recording medium is low.

13. The image forming method according to any one of claims 7 to 11, wherein toner image forming operations of the transparent image forming unit, the color image forming units, and black image forming unit are stopped when the transparent image carrier, the color image carriers, and black image carrier are not in contact with the intermediate transfer member.

14. An image forming apparatus, comprising:

a transparent image forming unit having a transparent image carrier at which a transparent toner image is formed;

a plurality of color image forming units arranged at a downstream side in a process direction of the transparent image forming unit, the color image forming units having color image carriers at which yellow, magenta, and cyan color toner images are formed respectively;

a black image forming unit arranged between the transparent image forming unit and the color image forming unit or at the downstream side in the process direction of the color image forming units, the black image forming unit having a black image carrier at which a black toner image is formed;

an intermediate transfer member to which the toner images formed on the transparent image carrier, the color image carriers, and the black image carrier, are transferred;

a retracing mechanism that brings the transparent image carrier into contact with the intermediate transfer member and separates the transparent image carrier from the intermediate transfer member; and a moving mechanism that brings the intermediate transfer member into contact with the color image carrier and separates the intermediate transfer member from the color image carriers, wherein the retracting mechanism and the moving mechanism are not mechanically interconnected with each other.

* * * * *